United States Patent [19]

Ward

[11] Patent Number: 4,520,509

[45] Date of Patent: Jun. 4, 1985

[54] MASK WITH REMOVABLE COUNTERCURRENT EXCHANGE MODULE

[76] Inventor: Russell G. Ward, 2050 SW. 71st Ave., Portland, Oreg. 97225

[21] Appl. No.: 467,914

[22] Filed: Feb. 18, 1983

[51] Int. Cl.[3] ..... A42B 1/18

[52] U.S. Cl. ..... 2/206; 2/DIG. 6; 128/206.17; 128/206.28

[58] Field of Search ..... 2/206, 9, DIG. 6, 5; 128/206.17, 206.12, 206.16, 206.19, 206.21, 206.28, 207.11, 205.25

[56] References Cited

U.S. PATENT DOCUMENTS

| | | | |
|---|---|---|---|
| 2,556,589 | 6/1951 | Le Duc | 128/206.12 |
| 2,751,904 | 6/1956 | Lewis | 128/206.17 |
| 2,818,857 | 1/1958 | Wilkins et al. | 128/206.28 |
| 3,152,588 | 10/1964 | Rogowski | 2/9 X |
| 4,458,679 | 7/1984 | Ward | 128/205.25 X |

FOREIGN PATENT DOCUMENTS

| | | | |
|---|---|---|---|
| 517113 | 1/1940 | United Kingdom | 2/9 |

OTHER PUBLICATIONS

Gershman, "Self Adhering Nylon Tapes", 10-18-58, J.A.M.A., vol. 68, No. 7, p. 930.

*Primary Examiner*—Peter Nerbun

*Attorney, Agent, or Firm*—James D. Givanan, Jr.

[57] ABSTRACT

A face mask for use in hazardous environments and comprising an elastic sheet for securement about the lower face and head. The sheet is partially folded to define an open area located forwardly of the wearer's nose and mouth and within which area is removably attached a filter body which may also constitute a countercurrent exchange medium. Fabric closure material on the elastic sheet and filter body serves to removably attach the filter body in place. Additional fabric closure strips of the hook and loop type, when mated to one another, hold the elastic sheet in a partially folded shape to define the aforementioned open area. The filter body may be of a fibrous nature or a molded nose cup shape.

7 Claims, 8 Drawing Figures

MASK WITH REMOVABLE COUNTERCURRENT EXCHANGE MODULE

BACKGROUND OF THE INVENTION

The present invention pertains generally to face masks of the type worn for protection from extreme temperatures and to masks having a filtering capacity.

In the prior art are several cold weather masks which partially or fully overlie the face. Air is admitted to the nose and mouth via a filtering medium such as a nosecup as shown in U.S. Pat. No. 3,768,100 which patent states that inhaled air is "well above the ambient temperature". The filtering medium used is the well known nosecup type of molded construction with a strip of closure material applied thereto for cup securement to an underlying edge of a fabric cold weather mask. A problem exists with such masks by reason of the sizeable dead air space within the masks which results in exhaled air being again inhaled causing an increase in carbon dioxide in the body. A further drawback to the prior art masks is the complexity of same resulting in substantial manufacturing costs and cumbersome to use.

U.S. Pat. No. 4,300,240 is somewhat more relevant to the present mask in that it is formed fron one piece of resilient neoprene foam for stretched engagement with the lower face and neck. Air passes through the mask via nose and mouth openings with little or no heat transfer (countercurrent exchange) from exhaled to inhaled air. No filter unit is provided in this prior art mask.

A copending U.S. patent application filed June 1, 1982, by the present inventor, under Ser. No. 383,465, now U.S. Pat. No. 4,458,679 discloses the use of a removable countercurrent exchange medium carried in a cup-shaped face mask shell for the conservation of body heat otherwise lost by respiration.

U.S. Pat. Nos. 3,908,648 and 4,038,979 disclose masks which removably mount a filter medium in a partial or full head enclosing mask. U.S. Pat. Nos. 2,344,920 and 3,818,510 disclose face masks each having a chamber opposite the nose and mouth through which respiratory air passes but with no filtering capability.

SUMMARY OF THE PRESENT INVENTION

The present invention is embodied in a face mask formed essentially from a fabric sheet and shaped to receive a porous body which provides filter and countercurrent exchange functions.

In the present mask a unitary piece of fabric material is of a size and shape to fit about the lower face and neck and serves to support the body of permeable material. Mask construction is greatly simplified by a major portion of same being done while the mask is in the form of a planar sheet of fabric. Subsequent folding of the piece of material shapes the mask to define a shaped receptacle within which is carried the filtering and/or countercurrent body. Closure material of the hook and loop type applied to the mask fabric during mask construction permits the mask to be thereafter shaped and sized into an operational configuration without the usual tedious and time consuming cutting and stitching operations normally associated with mask fabrication. Mask shape is retained by closure material to permit the mask to be reconfigured back to its planer state for maintenance and laundering purposes. Further, the use of closure material permits a degree of mask alteration to best fit same to the wearer.

Important objectives include the provision of a lightweight, comfortable mask for use in various hazardous environments which provides a filter or countercurrent medium of much greater mass than prior art masks; the provision of a mask having a permeable module carried in a readily attachable manner and which contributes to shaping a fabric component of the mask; the provision of a mask which avoids cumbersome straps, face cups and face contacting seals yet is adaptable to a full range of face sizes; the provision of a mask which lends itself to economical production by reason of being fabricated in sheet configuration and thereafter normally shaped into a mask configuration without additional sewing operations.

DETAILED DESCRIPTION OF THE PREFERRED EMBODIMENT

Figure 1:
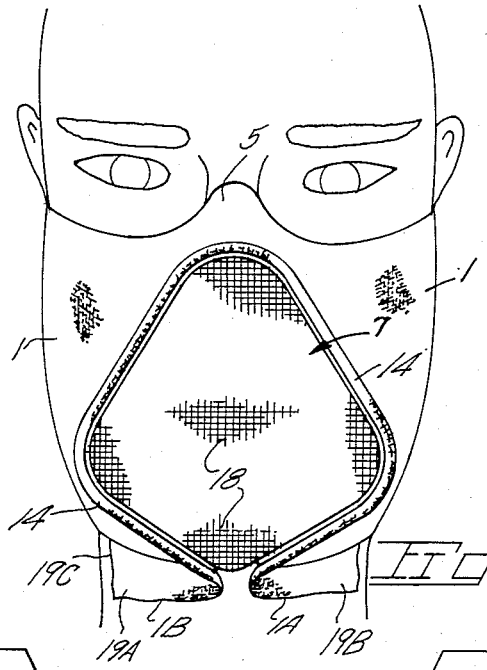
FIG. 1 is a front elevational view of the present mask in place on a wearer's lower face.
Figure 2:
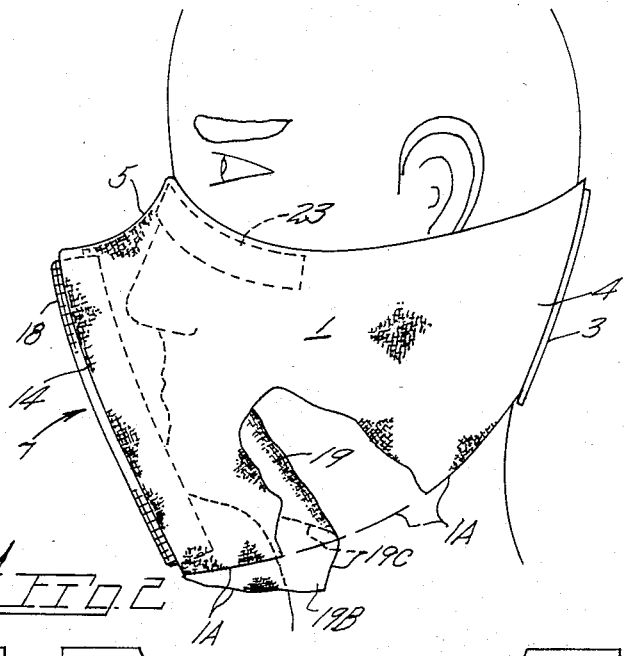
FIG. 2 is a side elevational view taken from the right side of FIG. 1.
Figure 3:
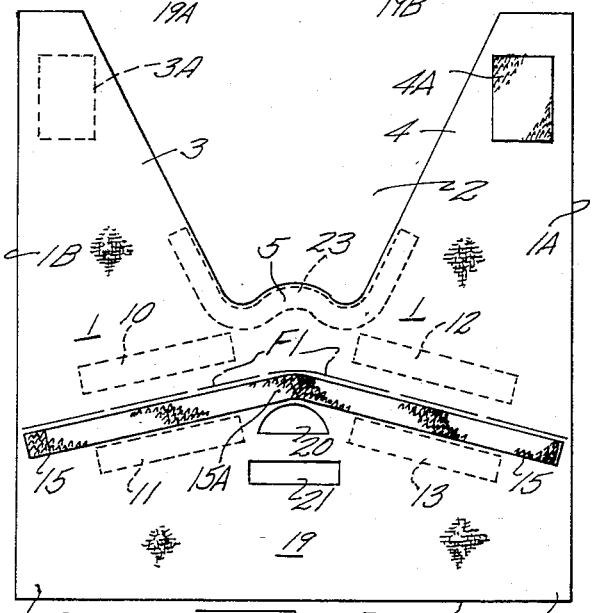
FIGS. 3 and 4 are plan views of opposite sides of the mask during mask assembly.
Figure 4:
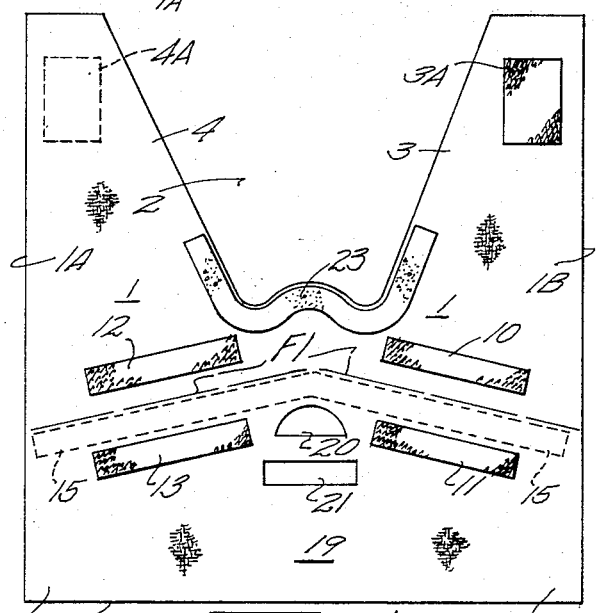

With continuong attention to the drawing wherein applied reference numerals indicate parts similarly hereinafter identified, the reference numeral 1 indicates the fabric component of the present mask which may be a single ply of elastic net material of the general type currently used in the manufacture of swimsuits and figure control garments, and sold under the registered trademarks of SPANDEX and LYCRA. Sheet side edges are at 1A and 1B.

The fabric is preferably configured for placement over the lower face including the nose, cheeks, ears (partially) and back of the head with a cut-out area 2 providing tapered extensions at 3 and 4 which lend themselves to convenient securement about the back of the head utilizing cooperable hook and loop fabric closure tabs at 3A and 4A on said extensions. The closure tabs as well as the later described closure material is of the type made and sold under the registered trademark VELCRO.

A mask portion at 5 is intended to overlie the bridge of the wearer's nose.

Figure 5:
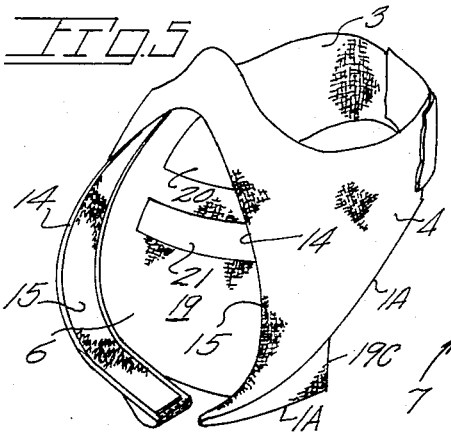
FIG. 5 is a perspective view of the present mask with the fibrous countercurrent exchange medium or filtering component removed therefrom.

The mask is adapted to be configured as later described to define an open area or receptacle 6 (FIG. 5) within which is removably located a porous filter body indicated generally at 7. While the term filter body is used in the following description, it is to be understood that the primary function of same may be as a countercurrent exchange medium with any filtering capability being of secondary importance. The filter body 7 and any interchangeable countercurrent exchange medium would have like perimetrical shapes.

Shaping of the frontal portion of the mask fabric into the above mentioned receptacle is accomplished by cooperating closure strips at 10-11 and 12-13 which engage one another. The sheet material is accordingly initially folded transversely along a fold line at F1 so as to have overlying positions so as to bring the pairs of closure strips 10-11 and 12-13 into substantially overlying engaging relationship with one another to provide an upstanding fold 14 perpendicular to the remaining sheet material. Attached as by stitching to fold 14 of sheet 1, is an attachment strip 15 also of closure material of the hook and loop type. Strip 15 is on an inner surface of fold 14.

Figure 6:
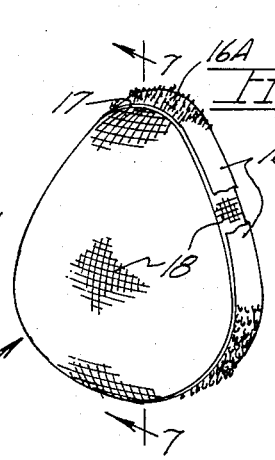
FIG. 6 is a perspective view of a fibrous countercurrent exchange medium or filtering component used in the present mask.

As shown in FIG. 6, filter body 7 may be of three dimensional shape with strip 16 of fabric closure or attachment material extending about the perimeter of the body. The curved upper extremity of filter body 7 is formed on a reduced radius at 17 for attachment of a band segment 16A to the center 15A of strip 15 whereafter strip 15 may be progressively pressed into engagement with the cooperating attachment band 16 on the filter body to form the sheet and particularly the fold 14 about the filter body.

Figure 7:
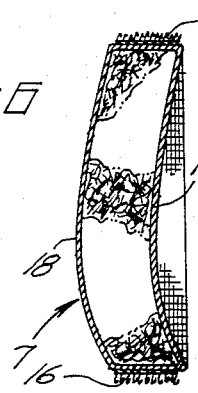
FIG. 7 is a sectional view taken along line 7—7 of FIG. 6.

The filter body may include a porous, durable enclosure, such as nylon netting 18, which overlies the filter or countercurrent material to fully confine same. Attachment band 16 may be applied as by stitching to the perimeter of the netting. Upstanding fold 14 and the closure strip applied to the inner side thereof (with reference to FIG. 5) are of a width so as to substantially overlie the edge of filter body 7. Filter body 7 is preferably of concave-convex configuration, per FIG. 7, to avoid impairing contact with the wearer's nose and chin.

Figure 8:
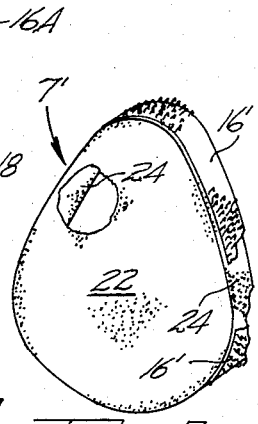
FIG. 8 is a perspective view of a molded filter component of the mask.

With attention to FIG. 8, a modified filter body is indicated generally at 7' and includes a molded cup shaped structure of a permeable nature having a frontal portion 22 with a rearwardly directed, continuous sidewall at 24 on which is carried an attachment band 16'. Filter body 7' may be formed from that permeable single ply material commonly used in the manufacture of commercially available nose cup filters used by those having dust and pollen allergies.

Sheet 1 has a liner portion at 19 provided by the lower portion of the sheet fabric and which portion serves to protect the lower face and jaw from contact with the filter body for purposes of comfort. Nose and mouth air passageways are at 20 and 21 and may be provided in liner 19. When worn, the corners 19A and 19B of the liner lie against the wearer's neck with the outer edges 1A-1B of the liner extending forwardly from corners 19A-19B and thence rearwardly toward the back of the head. A bottom liner edge is at 19C.

The filter body 7 may be primarily a countercurrent exchange medium of fibrous material such as that disclosed in my above mentioned earlier filed U.S. patent application when the mask is intended for use in cold climates. Such material may include a mass of inert fibrous material or discrete metallic particles both of which are confined within the closed netting 18. Alternatively, stainless steel sponge may be utilized as a countercurrent exchange medium with the selected material being enclosed within netting 18.

The mask may include a neoprene foam strip 23 secured in place on the inner (face) side of sheet 1. The strip is located adjacent the sheet edge passing below the wearer's eyes and extends over nose portion 5 of the sheet to contact the bridge of the nose. A malleable stiffener at 24 is disposed between nose portion 5 and underlying neoprene foam strip 23. Strip 23 constitutes a vapor barrier desirable in a mask for cold weather use to inhibit condensation on eyewear.

In forming of sheet 1 to define open area 6, mask configuration may be altered to a degree by varying the overlapped, mated relationship of the pairs of closure strips 10-11 and 12-13 as the strips may be joined in partially offset relationship to vary the width of fold 14.

If so desired, the sheet corners 19A-19B, defined by the intersection of edges 1B-19C and 1A-19C, may be closed when the sheet is in its mask configuration by closure material tabs in place along said edges adjacent said corners. With sheet 1 folded into mask configuration the tabs, when joined to one another, serve to retain fold 14 in substantially a cup shape with or without filter body 7 being in place. Further such closing of the overlapped corner edges, adjacent corners 19A and 19B, permits liner 19 to additionally confine an increased mass of filter or countercurrent exchange material which may extend laterally toward the closed corner areas from cup shaped area 6.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

I claim:

1. A face mask for protecting the wearer from hazardous environmental conditions such as cold temperatures or airborne particles, said mask comprising, a filter body of three dimensional shape, a fabric sheet which may be configured to define an open area within which said filter body is at least partially inset, means on said sheet for securing same to a wearer's face, closure strips on said fabric sheet to retain same in a desired configuration to define said open area, and attachment means in place on said sheet and about the perimeter of said filter body whereby the filter body may be retained in place within said open area in a removable manner.

2. The face mask claimed in claim 1 wherein that portion of said fabric sheet defining said open area is of folded configuration.

3. The face mask claimed in claim 2 wherein said closure strips when mated with one another form and retain the sheet in a partially folded configuration.

4. The face mask claimed in claim 3 wherein said fabric sheet includes a liner portion located inwardly of the filter body to partially cover the face when the mask is worn.

5. The face mask claimed in claim 1 wherein said attachment means are fabric closure strips.

6. The face mask claimed in claim 1 wherein said closure strips when mated with one another form and retain the sheet in a partially folded configuration.

7. The face mask claimed in claim 1 wherein said fabric sheet is of an elastic nature.

* * * * *